United States Patent [19]

McKinney

[11] 3,939,344

[45] Feb. 17, 1976

[54] PREFILTER-IONIZER APPARATUS FOR USE WITH QUADRUPOLE TYPE SECONDARY-ION MASS SPECTROMETERS

[75] Inventor: James T. McKinney, Stillwater, Minn.

[73] Assignee: Minnesota Mining and Manufacturing Company, St. Paul, Minn.

[22] Filed: Dec. 23, 1974

[21] Appl. No.: 535,805

[52] U.S. Cl. ..... 250/281; 250/292; 250/309; 250/427

[51] Int. Cl.[2] ..... H01J 39/34

[58] Field of Search ..... 250/292, 305, 309, 281, 250/282, 283, 427

[56] References Cited

UNITED STATES PATENTS

| | | | |
|---|---|---|---|
| 3,473,018 | 10/1969 | Brubaker | 250/292 |
| 3,859,226 | 1/1975 | Schillalies | 250/292 |

*Primary Examiner*—Craig E. Church
*Attorney, Agent, or Firm*—Alexander, Sell, Steldt & DeLaHunt

[57] ABSTRACT

A multipurpose apparatus is useful in either prefiltering ions or in forming ions from residual gases, prior to the analysis of the prefiltered or formed ions in a quadrupole type mass spectrometer. The apparatus includes a cylindrical grid, an annular entrance aperture wherein a center circular baffle has a unidimensional electrode extending along the axis of the grid, and a circular exit aperture, the axis of the grid being in line with the axis of a quadrupole type mass analyzer. The application of appropriate potentials to these members allows only low energy ions to pass therethrough and into the quadrupole analyzer. High energy ions or neutral particles having an axial trajectory are blocked by the baffle, while divergent high energy charged particles are insufficiently deflected and hence do not pass through the exit aperture. The apparatus further includes a filament positioned outside the grid, which, when energized, emits electrons. The electrons are accelerated toward the grid, passing therethrough whence they ionize residual gas atoms therein, which ionized atoms are extracted through the exit aperture and pass into the quadrupole analyzer.

8 Claims, 7 Drawing Figures

QUADRUPOLE MASS ANALYZER POWER SUPPLY
PRE-FILTER POWER SUPPLY
IONIZER FILAMENT POWER SUPPLY
ACCELERATION AND FOCUS POWER SUPPLY
FILAMENT POWER SUPPLY
DEFLECTION POWER SUPPLY
+2KV
88
86
98
74
82
69
70
72
76
78
80
84
58
56
16
45
42
22
27
26
24
50
60
62
90
92
94
96
10

PREFILTER-IONIZER APPARATUS FOR USE WITH QUADRUPOLE TYPE SECONDARY-ION MASS SPECTROMETERS

BACKGROUND OF THE INVENTION

1. Field of the Invention

This invention relates to apparatus for controlling the passage of ions into a quadrupole type mass analyzer.

2. Description of the Prior Art

Quadrupole mass analyzers are well known to those desiring to analyze ions such as may be sputtered from solid surfaces to allow determination of the composition of the surfaces and as may be produced upon electron impact on residual gases to allow determination of such gases. The use of such analyzers in secondary ion mass spectroscopy is disclosed by R. Schubert and J. C. Tracy, "A Simple, Inexpensive SIMS Apparatus", Rev. Sci. Instr. Vol. 44, pp 487–491, (1973). Those workers noted that quadrupole mass analyzers could most effectively mass analyze those secondary, i.e., sputtered ions having an energy less than about 4 eV, and that in the process of producing such low energy sputtered ions, a variety of particles including fast neutral atoms, x-rays, fast metastable ions and electrons were also produced. In order to prevent these particles from confounding the analysis of the low energy sputtered ions, they found it desirable to use a 180° segment of a cylindrical mirror analyzer as a prefilter in front of the quadrupole analyzer. The mirror analyzer was positioned to have its axis at an angle with respect to that of the quadrupole analyzer, such that a predominate fraction of the ions passing through the second slit in the inner cylinder were in line with the axis of the quadrupole analyzer while fast neutral atoms, high energy ions, etc. produced at the sample surface were prevented from passing directly down the axis of the cylindrical mass analyzer and into the quadrupole analyzer. Such a combination of elements is cumbersome and difficult to align. Further, the transmission coefficient of cylindrical mirror analyzers is low because they pass such a narrow band of energies and have relatively small acceptance angles.

As an adjunct to such secondary ion mass analysis it is often desirable to determine the composition of residual gases by ionizing the gases and passing the ions into the quadrupole analyzer. Accordingly, electron impact ionization chambers are known to provide the requisite ionization. However, prior to the present invention, the only known technique for performing the dual functions of prefiltering and of ionizing residual gases was a tandem arrangement of a prefilter and an ionizer ahead of the quadrupole. Such a tandem arrangement was inefficient, in that the arrangement requires additional electrical vacuum feedthroughs and special attention to prevent the possible deleterious interaction of the two assemblies, and in that the two assemblies themselves were required.

SUMMARY OF THE INVENTION

The apparatus of the present invention is a simple, axial prefilter/ionizer assembly having a large entrance aperture which is useful with quadrupole type mass analyzers. By "quadrupole type mass analyzers" is meant that class of radio frequency analyzers in which ions of the proper mass to charge ratio exhibit stable oscillations as the ions transverse along the field generating electrodes. In such analyzers, the stability of the trajectories is relatively independent of the ion energy and angle. Such analyzers typically have at least one axis of symmetry and include quadrupole, having four circular cylindrical electrodes equispaced about a common axis parallel to the cylindrical electrodes, monopole, octapole, and duodecapole types. Similarly, other analyzers, in which the mean trajectory is non-linear but in which stable oscillations in response to an RF field nonetheless occur, are included in the class description.

The apparatus includes an electrically conducting cylindrical grid having entrance and exit ends allowing the axial passage of ions therethrough, which grid is positioned in front of the input to the quadrupole mass analyzer such that the longitudinal axis of the grid is in line with the longitudinal axis of the quadrupole analyzer.

The apparatus further comprises an electrically conducting entrance aperture plate and an electrically conducting exit aperture plate, both of which are electrically insulated from the grid and from each other. The entrance aperture plate is positioned adjacent the entrance end of the grid such that the plane of the entrance plate is normal to the axis of the grid, while the exit aperture plate is positioned adjacent the exit end of the grid and is similarly normal to the axis thereof. The entrance aperture plate is provided with an annular opening concentric to the axis of the grid through which ions may be admitted into the grid and is further provided with a solid center portion forming a baffle, which portion is also concentric to the axis of the grid, and which prevents ions, neutral atoms and other particles such as may be directed toward the entrance end from passing directly along the axis through the grid. A substantially unidimensional electrode is attached to the center portion and extends within the grid and along the axis thereof substantially the full length of the grid. The exit aperture plate is provided with a circular opening concentric to the axis to restrict the passage of ions out of the grid. The application of predetermined potentials to the grid and to the entrance and exit aperture plates respectively causes ions entering the grid through said annular opening, and which have a relatively low energy, to be selectively transmitted out through said opening in the exit aperture plate to the quadrupole analyzer, and causes high energy ions, neutral atoms, and other particles, which contribute a complicating noise background to a spectrum provided by the quadrupole mass analyzer, not to be transmitted to the quadrupole analyzer.

The apparatus thus effectively filters out high energy ions, neutral atoms, photons, and other particles, keeping them from passing through to the quadrupole analyzer. The apparatus is significantly superior in construction to that of cylindrical mirror analyzers in that it is simpler, in that the axial alignment of the respective members facilitates assembly, and in that separate focusing lenses may be eliminated, while yet providing the required energy filtering at high transmission coefficients.

While cylindrical mirror analyzers are often especially desirable in that they are capable of high energy resolution, provided that particular ratios of the diameter of the inner and outer cylinder are selected, such high resolution attributes are not desired when used as a prefilter where it is simply desired only to eliminate all ions having an energy above a certain value.

Further, quadrupole type mass analyzers inherently have wide entrance acceptance angles, and are relatively quite tolerant to off-axis directed incoming ions. Accordingly, incoming ions deflected onto the optic axis at the entrance aperture of the quadrupole type mass analyzer at relatively wide angles can still be effectively mass filtered, thus permitting the use of the axial/prefilter ionizer apparatus of the present invention.

The apparatus preferably further includes a source of electrons and an electron permeable chamber electrically biased with respect to the source of electrons to cause electrons produced by the source to pass into the chamber to ionize atoms contained therein. Under such operating conditions, other predetermined potentials may be applied to the grid and to the entrance and exit aperture plates to cause the ionized atoms to be directed through the grid and into the quadrupole mass analyzer to determine the mass of the ionized atoms.

In a particularly preferred embodiment, the electron permeable chamber is formed by the combination of the grid and entrance and exit aperture plates. An outer cylindrical shell is also positioned concentric to the grid, the electron source being between the grid and the shell. When a negative voltage is applied to the shell with respect to the filament, electrons from the source are repelled from the shell and traverse the chamber many times until they collide with an atom or strike the grid.

The above described preferred embodiment is particularly desirable in that a single axial apparatus is now provided which is capable of prefiltering incident ions, allowing low energy ions to pass therethrough with high transmission, and which is capable of analyzing residual gases. The apparatus is capable of providing these dual functions without requiring changes in the configuration of the components within an evacuated chamber and without requiring a large number of electrical feedthroughs into the vacuum chamber. Likewise, special precautions which are otherwise necessary to ensure that separate prefilter and ionizer assemblies do not interact to reduce the efficiency of ion collection may now be avoided.

DESCRIPTION OF THE PREFERRED EMBODIMENTS

In a preferred embodiment, the present invention combines in a single apparatus members capable of functioning both as a prefilter and as an ionizer, whereby ions created externally and introduced into the apparatus or created within the apparatus may be selectively transmitted into a quadrupole type mass analyzer for final analysis.

Figure 1:
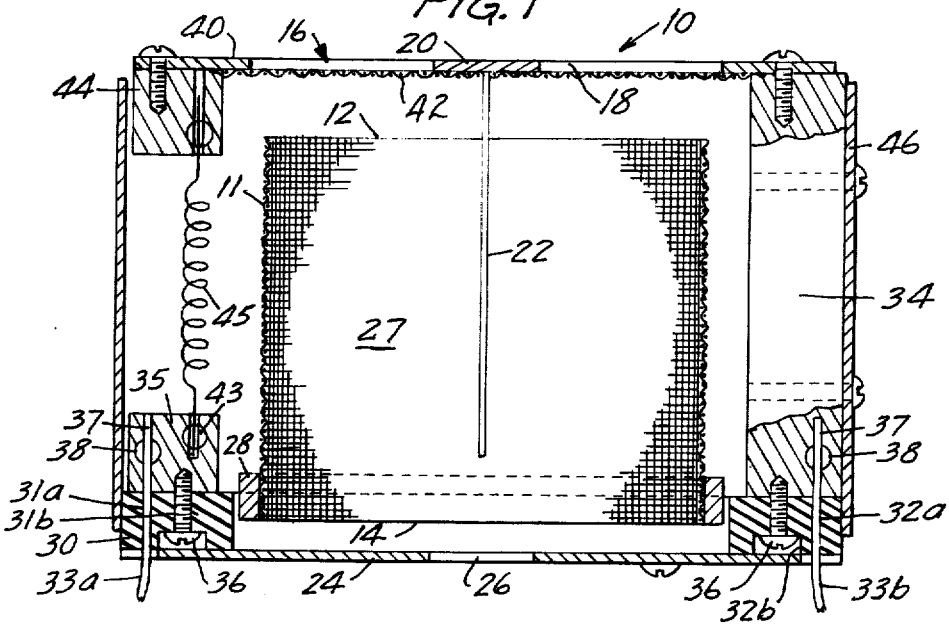
FIG. 1 is a cross section of a preferred form of the ionizer-prefilter apparatus of the present invention.

In such a preferred embodiment, the ionizer-prefilter apparatus 10, as shown in FIG. 1, includes an electrically conductive cylindrical grid 11, an electrically conductive entrance aperture plate 16 positioned adjacent an entrance end 12 of the grid 11 and an electrically conductive exit aperture plate 24 positioned adjacent the exit end 14 of the grid 11, thereby defining an electron permeable chamber 27, within which charged particles such as electrons and ions may be controlled by the application of appropriate potentials to the respective members. The plate 16 includes an annular opening 18 which may be covered by a wire mesh through which ions may be admitted into the chamber 27. Ions are precluded from entering the chamber 27 along the axis of the grid 11 by a circular baffle 20 centered about the axis of the grid 11. Secured to the center of the baffle 20 is an elongate unidimensional electrode 22 which axially extends within the grid 11 substantially the full length thereof. The exit aperture plate 24 has a circular opening 26 concentric to the axis of the grid 11 through which ions may pass out of the grid 11.

In a preferred construction, the apparatus includes a ceramic base member 30, preferably made of a machineable ceramic such as aluminum oxide, provided with multiple openings through which screws may be inserted to secure the various members to the base member 30. Electrical connection to the various members is also provided through the openings. Thus as is partially shown in FIG. 1, the base member 30 includes at least four pairs of holes, two pairs of which are shown as 31*a* and 31*b* and 32*a* and 32*b*. The outer hole of each pair, 31*a* and 32*a*, is preferably used to allow electrical leads 33*a* and 33*b* to be inserted therethrough. The inner holes 31*b* and 32*b* are provided with recesses to receive the heads of screws 36 to secure additional members such as a support post 34 and a connection block 35. The heads of the screws 36 are thus below the surface of the base member 30 and hence do not make electrical contact to the exit aperture plate 24 when that plate is secured to the bottom surface of the base member 30. Additional holes are provided around the member 30 to facilitate axial connection of the ionizer-prefilter assembly to a quadrupole type mass analyzer.

In addition to being tapped to receive the mounting screws 36, the support post 34 and connection block 35 are provided with openings 37 matching the outer holes 31*a* and 32*a* in the base member 30 such that leads inserted through the outer holes may be received by the openings 37, whence they are secured and good electrical contact thereto ensured by the set screws 38. Preferably, such leads are formed of 0.060 inch (1.52 mm) stainless steel rods.

The cylindrical grid 11 is preferably formed of 16 mesh stainless steel screen having approximately 73% open area. The grid preferably has an outside diameter of 1.12 inch (2.85 cm) and has an axial length of 1.00 inch (2.54 cm). The base of the grid 11 is spot welded to a grid support ring 28 having an outer flange (not shown) in regions not adjacent the support post 34 or a connecting block 35 for positioning the grid 11 on top of the base member 30. The flange is removed from the portions of the ring 28 adjacent the post 34 and connecting block 35 to ensure electrical insulation between the respective members.

Figure 2:
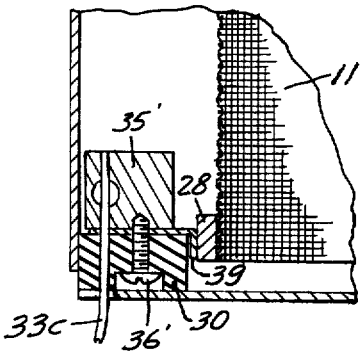
FIG. 2 is a break-away cross section of the base portion of the apparatus shown in FIG. 1, along another radial line.

As shown in more detail in the cutaway cross sectional view of FIG. 2, the grid support ring 28 has welded thereto a stainless steel tab 39, which tab is mechanically secured below a connection block 35'. The block 35' is secured to the base member 30 by a recessed screw 36'. An electrical lead 33c secured to the connecting block 35' completes the electrical connection to the grid 11 in the manner previously described.

The entrance aperture plate 16 is screwed to the support post 34 such that the unidimensional electrode 22 is along the axis of the cylindrical grid 11. Electrical connection to the entrance aperture plate 16 is completed via lead 33b through the post 34 to the plate 16. A radial electrical field distorted at the entrance and exit plates into an axial retarding field may thus be established by the application of a D.C. voltage to the respective members.

The plate 16 preferably comprises an outer stainless steel ring 40, to which may be welded a stainless steel screen 42 which, although partially restricted, forms the annular opening 18. The baffle 20 is spot welded to the screen 42, and the electrode 22 is in turn welded to the baffle 20.

It is to be understood that while the electrode 22 is preferably as small in diameter as practical, thereby decreasing the number of ions colliding with the electrode, the electrode may be somewhat larger, as long as the field remains substantially radial.

The exit aperture plate 24 is preferably formed of 0.016 inch (0.36 mm) thick stainless steel, and has a circular opening 3/16 inch (4.8 mm) in diameter. The plate 24 is secured to the base member 30 by a screw which passes through the member 30 to another connection block (not shown). A lead completing electrical connection to the plate 24 is passed through the member 30 and is secured to the block in the same manner set forth hereinabove. Openings are provided about the periphery of the plate 24 to avoid shorting out the leads passing through the member 30.

In a further embodiment of the invention, also shown in FIG. 1, an electron source such as a tungsten filament 45 is positioned outside the grid 11. The filament is supported by and connected at one end to the support block 35 via a set screw 43. Electrical connection thereto is completed via lead 33a. The other end of the filament 45 is supported by and connected to another support block 44 in the same manner previously described, which block is screwed to the entrance aperture plate 16, one end of the filament 45 thus being electrically connected to the plate 16.

The ionizer-prefilter assembly is enclosed by a stainless steel cylindrical shield 46 having an inner diameter the same as the outer diameter of the ceramic base member 30. The shield 46 is secured by means of screws inserted through the shield 46 into tapped holes on the supporting post member 34.

Figure 3:
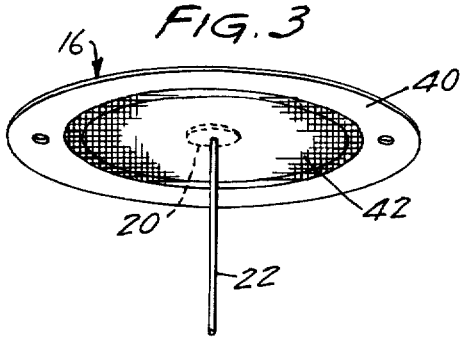
FIG. 3 is a three dimensional view of the entrance aperture plate and center electrode assembly used in the apparatus shown in FIG. 1.

FIG. 3 shows a detailed perspective view of the entrance aperture plate 16. The plate is there shown more clearly to include the outer stainless steel ring 40, the stainless steel screen 42 spot welded to the ring 40 and the center baffle plate 20 which is spot welded to the screen and which is concentric with the outer ring 40. The center electrode 22 is similarly spot welded concentric with the center baffle plate 20 and is preferably made of 0.006 inch (.150 mm) tungsten wire. The ring 16 is provided with holes to facilitate securing the plate 16 to the support post 34 and to facilitate securing the connecting block 44 to the plate 16.

Figure 4:
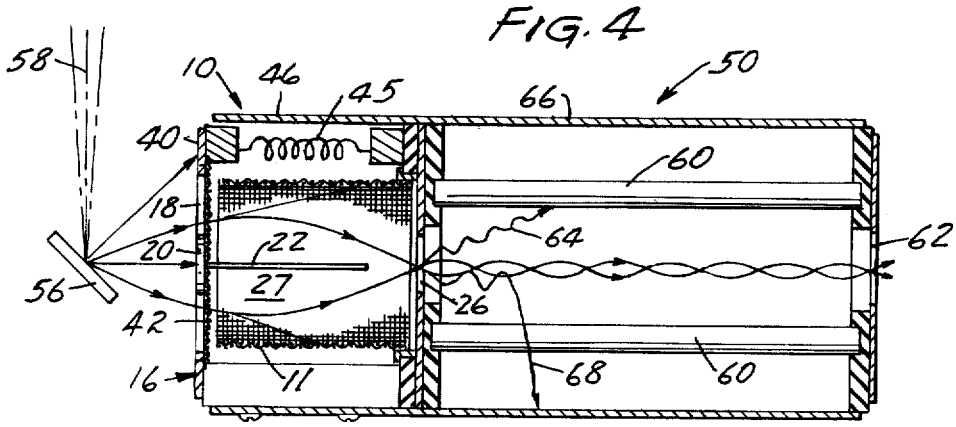
FIG. 4 is a cross sectional view of an apparatus including the ionizer-prefilter apparatus depicted in FIG. 1, together with a quadrupole mass analyzer.

FIG. 4 is illustrative of the operation of the ionizer-prefilter apparatus 10 together with a quadrupole mass analyzer 50 when used to analyze incoming ions. In this figure, ions are produced from a target surface 56 as a result of bombardment of the target surface by electrons, ions, or other neutral energetic particles 58. The bombardment causes ions to be ejected from the surface of the target 56, a fraction of which will be intercepted by the apparatus 10. As may be seen, certain ions, neutral atoms and other particles will have a trajectory such that they will be blocked by the center baffle 20. Other ions will have a trajectory such that they impinge upon the outer ring 40 and will be blocked from entering the prefilter apparatus. Those ions having a trajectory such that they are directed toward the screen 42 forming the annular entrance aperture 18 will thereby pass through the entrance aperture plate 16 and will enter the chamber 27. Some of the ions thus entering the chamber 27 have relatively high energies and are, therefore, not appreciably deflected by the potentials applied to the center electrode 22 and the cylindrical grid 11. Such high energy ions impinge upon the walls of the grid assembly 11, passing therethrough, or impinge on the exit aperture plate 24 and thus do not pass into the quadrupole analyzer 50. Similarly, ions of the opposite polarity entering the prefilter will be deflected away from the axis thereof and will not pass through the exit aperture 26. Only such ions as have a relatively low energy and the proper polarity will be deflected in response to potentials applied to the cylindrical grid 11, center electrode 22 and entrance and exit aperture plate 16 and 24 respectively, to pass through the exit aperture 26 and thence into the quadrupole mass analyzer 50.

Upon the application of a high frequency alternating electric field to the quadrupole rods 60, only two of which are shown, ions having a predetermined mass to charge ratio will be caused to exhibit an oscillating path between the quadrupole electrodes 60, thereby passing through the quadrupole analyzer and exiting from the analyzer through the quadrupole analyzer exit aperture 62. Other ions not having the requisite mass to charge ratio will be subjected to various alternating trajectories and will thus impinge upon either the quadrupole rods 60 such as shown by ray 64 or will impinge upon the outer shield 66 of the quadrupole assembly as shown by ray 68. In the embodiment depicted in FIG. 4, the outer shield 66 is an extension of the outer cylindrical housing 46 shown in FIG. 1.

While FIG. 4 is primarily illustrative of the use of the ionizer-prefilter apparatus 10 as a prefilter, it should also be recognized that the device has considerable utility as an ionizer such as for residual gas analysis. In such a use, rather than having ions produced external to the assembly such as by means of bombardment of the target 56, the filament 45 is heated to emit electrons by applying a potential to leads 33a and 33b (FIG. 1). The electrons either pass directly through the grid 11 into the chamber 27, or are deflected by the outer cylinder 46, and thence pass through the grid 11 into the chamber 27. The electrons impinge upon and ionize gas atoms contained within the chamber. The resultant ions may then be extracted through the exit aperture plate 26 and thereafter be analyzed in the quadrupole mass analyzer 50.

Figure 5:
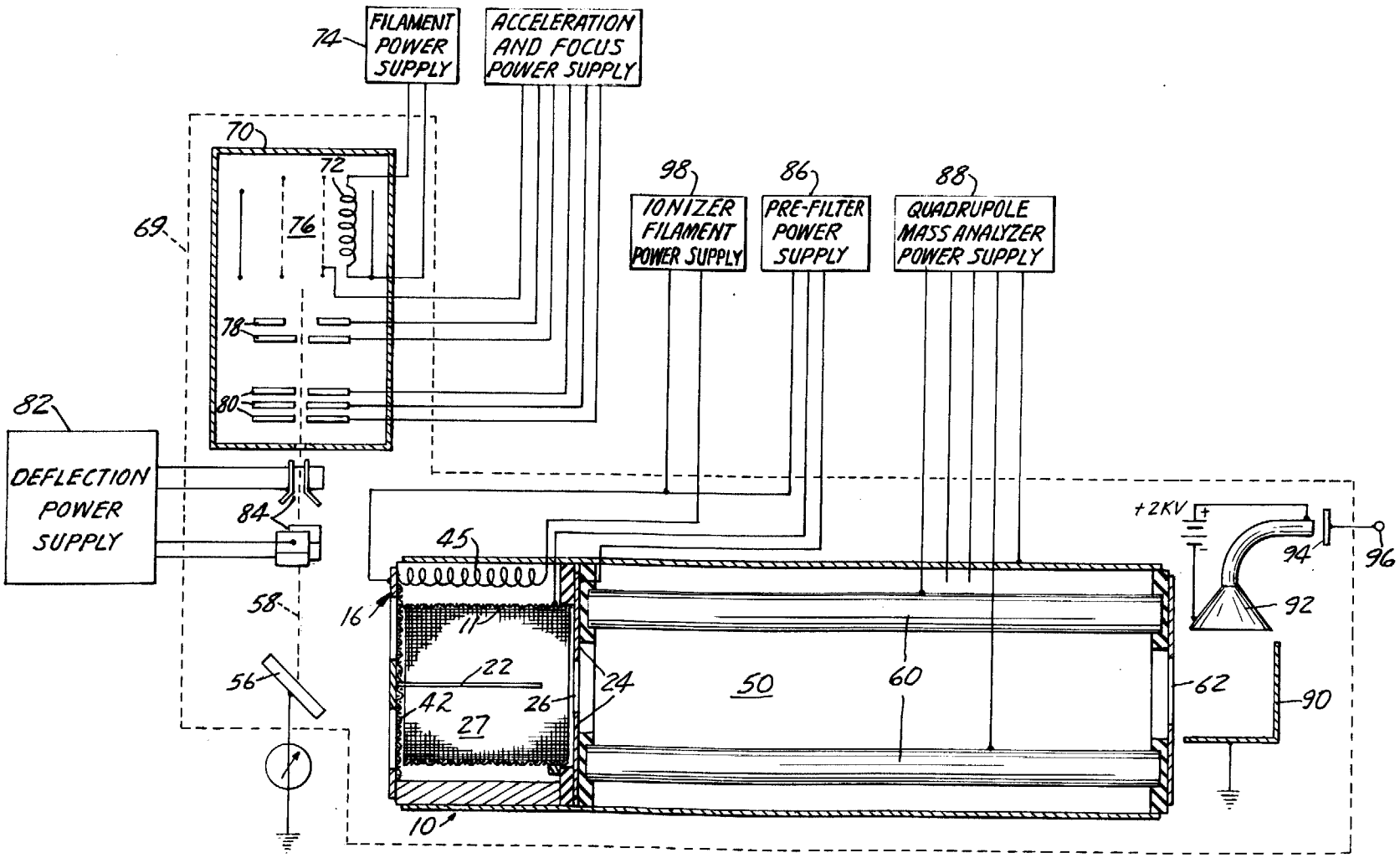
FIG. 5 is a block diagram in both pictorial and schematic form of the apparatus of FIG. 3 together with associated electrical components.

FIG. 5 is a combined cross section and block diagram of a system including the ionizer-prefilter apparatus 10 shown in the preceding figures. Such a system includes an evacuatable enclosure 69, within which various members are positioned. An ion gun 70, such as is described in U.S. Pat. No. 3,665,182 includes a filament 72, which when energized by the filament power supply 74, emits electrons which are accelerated into a first ionization region 76. The gun 70 further includes extraction and anode plates 78 and 80, respectively, to extract and focus the ions into a beam 58. A deflection power supply 82 and deflection plates 84 enable deflection of the beam 58 to control the impingement of the beam on the surface of the target 56. A portion of the ions sputtered or scattered from the surface then enter the ionizer-prefilter apparatus 10 whereupon, by the application of appropriate potentials from a prefilter power supply 86 to the grid 11, entrance aperture plate 16 and electrode 22, and exit aperture plate 24, only low energy ions pass to the quadrupole mass analyzer 50. The quadrupole mass analyzer power supply 88 provides RF voltages to the quadrupole plates 60 to further control the passage of ions out the exit aperture 62. The emergent ions may alternatively be deflected by the member 90 into an ion detector 92, whence they are converted into electrons, and collected by the electron collector 94 to generate an electronic signal on lead 96 in a manner well known to those skilled in the art. If sufficient ion current in present, the member 90 may be connected directly to lead 96 to provide an output signal.

When the disclosed device of FIG. 5 is operated as an ionizer for residual gas analysis by the quadrupole analyzer 50, the ion source 70 is not energized, and thus there are no sputtered ions entering the device. Instead, the ionizer filament power supply 98 is energized, thereby heating the filament 45 to emit electrons which are accelerated into the chamber 27 by an applied potential. Residual gases in the chamber 27 are ionized thereby, and are thence extracted through the exit aperture 26 as previously set forth.

In a typical use of the embodiment shown in FIG. 5, the apparatus is used to prefilter positive ions. After evacuating the ultrahigh vacuum chamber 69 to a pressure of less than $10^{-8}$ Torr, an inert gas (Ne) is admitted into the chamber, raising the pressure to approximately $5 \times 10^{-5}$ Torr. The ion gun 70 is then energized, allowing a beam of ions 58 (approximately 2 $\mu$A total current, 1 diam., 2.5 keV energy) to strike the target 56 being analyzed. Ions sputtered therefrom consist of both positive and negative ions, and leave the target with a broad range of energies. To select the positive ions, the target is placed at +3.0 volts; the entrance and exit aperture plates 16 and 24 respectively are placed at −2.0 volts and the cylindrical grid 11 is placed at +5.0 volts. When the respective members are so biased, the only ions exiting through the exit aperture 26 are those positive ions having a sufficiently low energy such that the quadrupole mass analyzer 50 is capable of unit mass resolution. The optimum potential on the respective members within the prefilter apparatus 10 is preferably determined by maximizing the signal passing through the analyzer 50 without an attendent decrease in mass resolution. For analysis of negative sputtered ions, these polarities would be reversed, but the magnitudes would be nearly the same.

Figure 6:
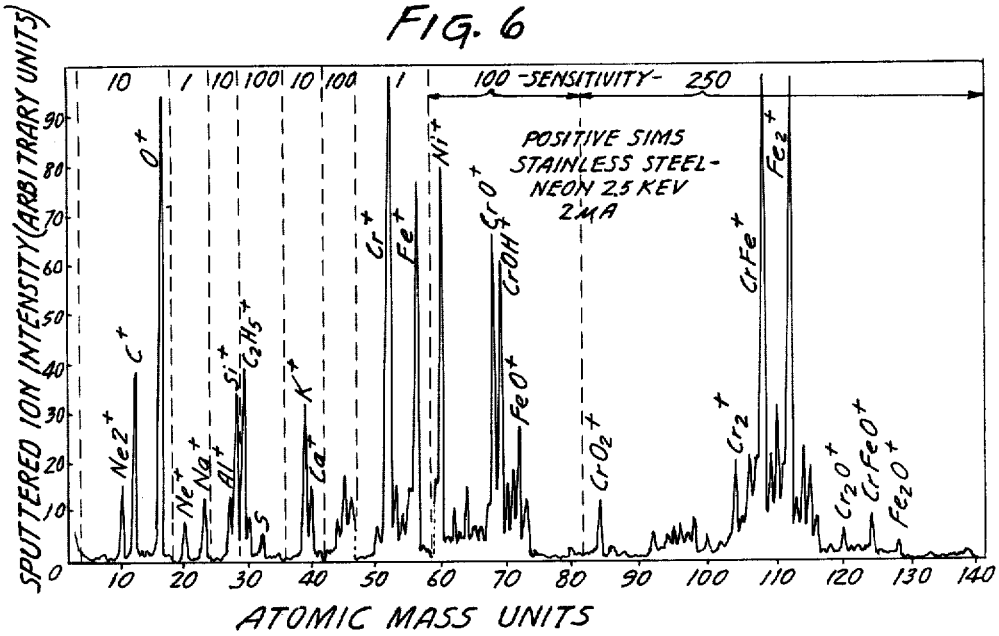
FIG. 6 is a typical spectrum obtained when the apparatus of the present invention is used as a prefilter.

FIG. 6 shows a typical positive secondary ion mass spectrum obtained under the conditions set forth hereinabove from a stainless steel target showing the relative intensity of atoms as a function of atomic mass. As may be seen, signals that vary over four orders of magnitudes are easily discerned with unit mass resolution. The sensitivity in portions of the spectrum differs as noted at the top of the figure.

In a typical use of the ionizer-prefilter 10 in the ionizer mode to enable the analysis of residual gases such as may be present in the chamber 69 during the pumpdown cycle and prior to back filling the chamber with inert gas, i.e., at a pressure of approximately $9 \times 10^{-7}$ Torr, the cylindrical grid 11 is placed at +27 volts, the exit aperture plate 24 is placed at zero volts, entrance aperture plate 16, which is also one end of the filament 45, is placed at −27 volts, and the other end of the filament 45 is placed at −32 volts. When so energized, an electron current on the order of 2 mA flows into the chamber 27, with an energy of 54 volts. During the resultant collisions of the electrons with the residual gas atoms, some of the atoms are ionized and are extracted through the exit aperture 26, passing into the quadrupole mass analyzer 50 with a maximum energy of approximately 27 volts.

Figure 7:
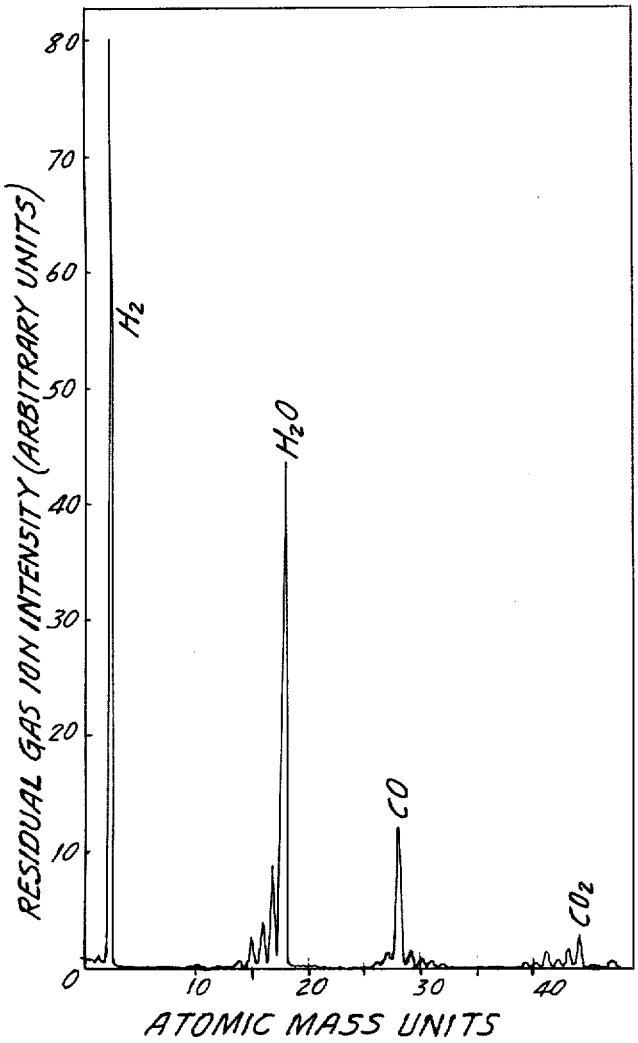
FIG. 7 is a typical spectrum obtained when the apparatus of the present invention is used as an ionizer for residual gas analysis.

FIG. 7 shows a typical residual gas analysis spectrum obtained by the quadrupole mass analyzer 50 under the conditions set forth hereinabove. As may be seen, the peaks are due to residual $H_2$, $H_2O$, CO, $CO_2$ and hydrocarbons. The spectrum exhibits unit mass resolution throughout the range of interest and is accompanied by very low noise background. Mass 1 and 2 peaks are easily distinguished. Good mass resolution and high signal to noise ratios are often difficult to achieve for such low masses. This is because of the very high noise signals that customarily occur at the lowest mass settings, and is believed to occur because extraneous ions having particular energies and trajectories at the entrance to the quadrupole filter are not adequately removed by the filter when the potentials on the quadrupole rods are near zero.

Having thus described the present invention, what is claimed is:

1. An apparatus for use with a quadrupole type mass analyzer comprising:

an electrically conductive cylindrical grid having entrance and exit ends allowing the axial passage of ions therethrough, positioned in front of the input to the quadrupole mass analyzer such that the longitudinal axis of the grid is in line with the longitudinal axis of the quadrupole analyzer;

an electrically conductive entrance aperture plate electrically insulated from said grid and positioned adjacent said antrance end thereof such that the plane of the entrance plate is normal to said axis of said grid, said entrance aperture plate having an annular opening concentric to said axis of said grid through which ions may be admitted into said grid, having a solid center portion forming a baffle to prevent ions, neutral atoms, photons and other particles such as may be directed toward said entrance end from passing directly along said axis through said grid, and having a substantially unidimensional electrode attached to said center portion and extending within said grid and along said axis thereof substantially the full length of said grid; and an electrically conductive exit aperture plate electrically insulated from said grid and positioned adjacent said exit end such that the plane of the exit aperture plate is normal to said axis, said exit aperture plate having a circular opening concentric to said axis of said grid to restrict the passage of ions out of said grid, whereby the application of predetermined potentials to said grid and to said entrance and exit aperture plates respectively causes ions entering said grid through said annular opening and which have a relatively low kinetic energy to be selectively transmitted through said opening in said exit aperture plate, and causes high kinetic energy ions, neutral atoms, photons and other particles not to be transmitted.

2. An apparatus according to claim 1, wherein the diameter of said center portion of said entrance aperture plate, the diameter of said circular opening in said exit aperture plate and the distance from the end of the unidimensional electrode adjacent said exit aperture plate to said exit aperture plate are all approximately equal.

3. An apparatus according to claim 1, further comprising a source of electrons and an electron permeable chamber whereby the application of an electrical bias to said chamber with respect to said source of electrons causes electrons produced by said source to be directed toward and to pass into the chamber to ionize atoms therein and the application of other predetermined potentials to said grid and to said entrance and exit aperture plates causes said ionized atoms to be directed through said exit aperture plate.

4. An apparatus according to claim 3 further comprising an electrostatic shield surrounding said chamber, said electron source being positioned between said chamber and said electrostatic shield.

5. An apparatus according to claim 3, wherein said electron source is a filament comprising an elongated helix of a refractory metal, the filament being positioned between the shell and grid, the axis of the helix being parallel to the common axis of the shell and grid.

6. An apparatus according to claim 1, wherein said grid and said entrance and exit aperture plates define an electron permeable chamber and said apparatus further comprises a cylindrical electrically conductive electron impermeable shell concentrically positioned outside said grid and a source of electrons between said shell and said grid, whereby the energization of said source of electrons and the application of an electrical bias to said grid with respect to said source of electrons causes electrons to be directed toward and to pass into said chamber and the application of other predetermined potentials to said entrance and exit aperture plates with respect to said grid causes said ionized atoms to be directed through said exit aperture plate.

7. A secondary ion mass spectrometer comprising an ion gun adapted for bombardment of a material to thereby sputter and ionize atoms from said material, an ion selection apparatus including an electrically conductive cylindrical grid having entrance and exit ends allowing the axial passage of ions therethrough, an electrically conductive entrance aperture plate electrically insulated from said grid and positioned adjacent the entrance end thereof such that the plane of the entrance plate is normal to the longitudinal axis of said grid, said entrance aperture plate having an annular opening concentric with the longitudinal axis of said grid through which ions may be admitted into said grid, the center portion of the entrance aperture plate forming a baffle to prevent ions such as may be directed toward the entrance end from passing directly along said axis through said grid and having a substantially unidimensional electrode attached to the center portion and extending within said grid and along said axis thereof substantially the full length of said grid, an electrically conductive exit aperture plate electrically insulated from said grid and positioned adjacent the exit end thereof such that the plane of said exit aperture plate is normal to said axis of said grid, said exit aperture plate having a circular opening concentric with said axis to restrict the passage of ions out of said grid, whereby the application of predetermined potentials to said grid and to the entrance and exit aperture plates respectively causes ions entering the grid through said annular opening and which have a relatively low energy to be selectively transmitted out through said opening in said exit aperture plate, a quadrupole mass analyzer axially positioned adjacent the exit aperture plate, the longitudinal axis of said grid and that of said analyzer being in line such that ions transmitted through said exit aperture plate pass into the analyzer and are selectively transported therethrough in accordance with the mass of said ions and the potentials applied to said quadrupole mass analyzer, and ion detecting means positioned adjacent said quadrupole analyzer to receive ions transmitted therethrough and to generate a signal corresponding to such transmitted ions.

8. An ion mass spectrometer according to claim 7, further comprising a source of electrons and an electron permeable chamber electrically biased with respect to said source of electrons to cause electrons produced by said source to be directed toward and to pass into said chamber to ionize atoms contained therein whereby the application of other predetermined potentials to the grid and to said entrance and exit aperture plates causes said ionized atoms to be directed through said grid and into said quadrupole mass analyzer to determine the mass of said ionized atoms.

* * * * *